US006382724B1

(12) United States Patent
Piretti

(10) Patent No.: US 6,382,724 B1
(45) Date of Patent: May 7, 2002

(54) TILTING SEAT CHAIR

(75) Inventor: Giancarlo Piretti, Bologna (IT)

(73) Assignee: Pro-Cord Srl, Bologna (IT)

( * ) Notice: Subject to any disclaimer, the term of this patent is extended or adjusted under 35 U.S.C. 154(b) by 0 days.

(21) Appl. No.: 09/584,390

(22) Filed: Jun. 1, 2000

(30) Foreign Application Priority Data

Jun. 4, 1999 (IT) ..... TO99A0477

(51) Int. Cl.[7] ..... A47C 1/024
(52) U.S. Cl. ..... 297/302.3; 297/303.3
(58) Field of Search ..... 297/302.3, 302.6, 297/302.7, 303.3, 300.4

(56) References Cited

U.S. PATENT DOCUMENTS 2,784,767 A * 3/1957 Soderberg ..... 297/300.4
2,935,119 A * 5/1960 Lie ..... 297/303.3
3,240,528 A * 3/1966 Ciuffini et al. ..... 297/303.3
3,250,567 A * 5/1966 Parrott ..... 297/303.3
3,402,964 A * 9/1968 Williams ..... 297/303.3
3,612,604 A * 10/1971 Meinhardt ..... 297/303.3
4,235,408 A 11/1980 Sapper
4,438,978 A * 3/1984 Arild ..... 297/302.3
4,906,045 A 3/1990 Hofman

FOREIGN PATENT DOCUMENTS

EP 0419 404 A 3/1991

* cited by examiner

*Primary Examiner*—Jerry Redman
(74) *Attorney, Agent, or Firm*—Sughrue Mion, PLLC

(57) ABSTRACT

Tilting seat chair, comprising: a base structure (16) bearing a transverse tilting axis (24), a seat support structure (14), tiltably mounted about the transverse tilting axis (24), an elastic arrangement for opposing the seat tilting motion, and an adjustment device (42) for varying the force opposing the elastic arrangement. The aforesaid elastic arrangement comprises a torsion bar (32) connecting the seat support structure (14) to the base structure (16) in a tilting manner about the transverse tilting axis (24). The torsion bar (32) has at least a first portion (32*a*) rotatably connected to the seat support structure (14) and at least a second portion (32*b*) connected to the base structure (16) through the aforesaid adjustment device.

2 Claims, 6 Drawing Sheets

TILTING SEAT CHAIR

FIELD OF THE INVENTION

This invention relates to a chair with a tilting seat, of the type comprising:

a base structure bearing a transverse tilting axis, a seat support structure, tiltably mounted about the said transverse tilting axis, elastic means capable of opposing the seat tilting motion, and means of adjustment for varying the force opposing the said elastic means.

SUMMARY OF THE INVENTION

The purpose of this invention is to provide a chair with a tilting seat of the type described above, provided with elastic means and adjustment means having a particularly simple or robust and compact structure. A further object of this invention is to provide a device for adjustment of the elastic means which opposes the tilting of the seat, which device does not require a large operating force.

BRIEF DESCRIPTION OF THE DRAWINGS

This invention will now be described in detail with reference to the appended drawings, given purely by way of a non-restrictive example, in which.

DETAILED DESCRIPTION OF THE INVENTION

Figures 1, 6:
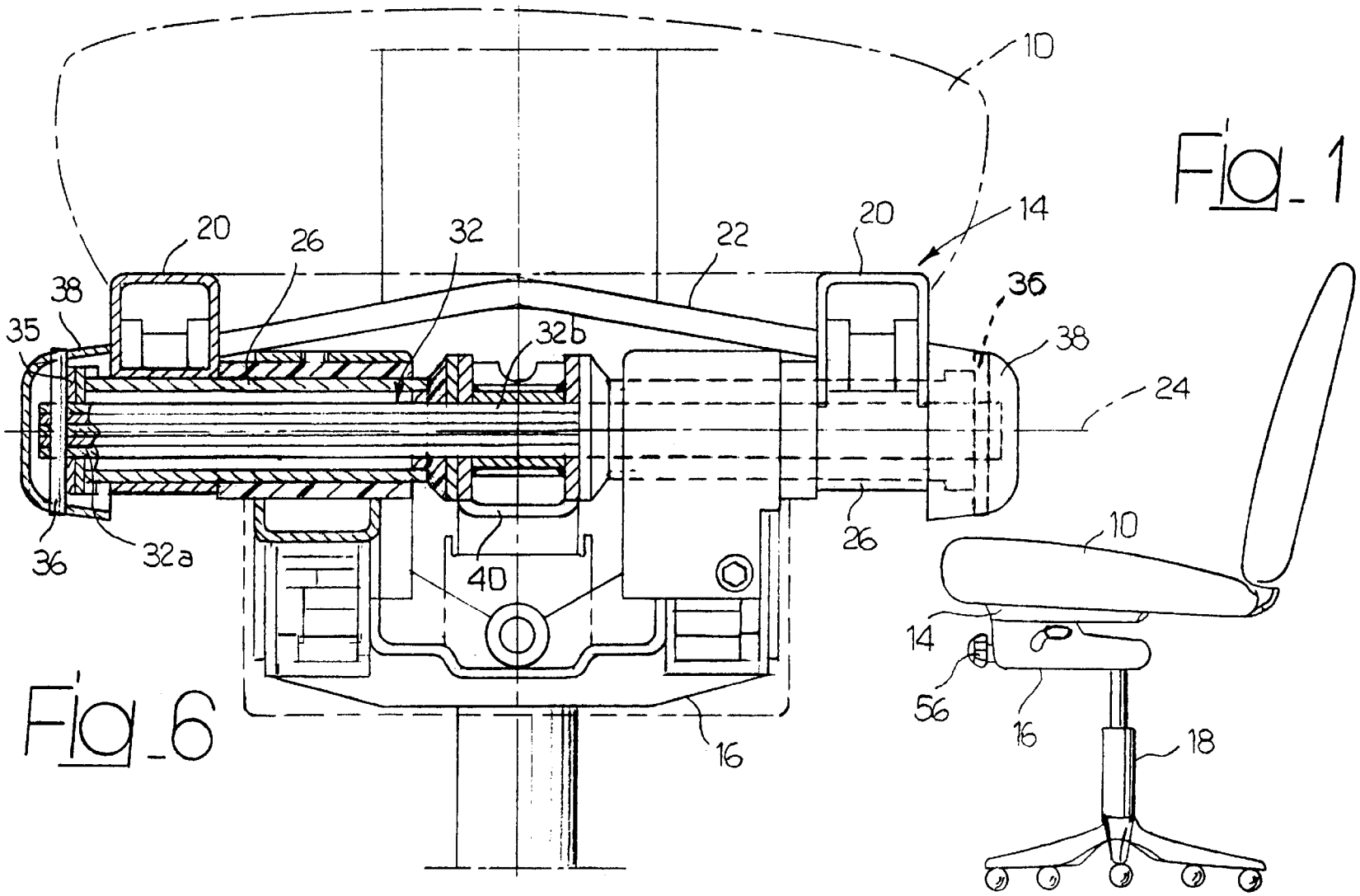
FIG. 1 is a diagrammatical side view of a chair according to the invention.
FIG. 6 is a partial cross section along the line VI—VI in FIG. 3.

FIG. 1 illustrates a chair provided with a seat 10 and a back 12. Seat 10 is fixed to a seat supporting structure 14 which is tiltably mounted about a transverse axis with respect to a base structure 16 mounted at the top of a central support 18, of a type which is in itself known, which can be adjusted for height.

Figure 2:
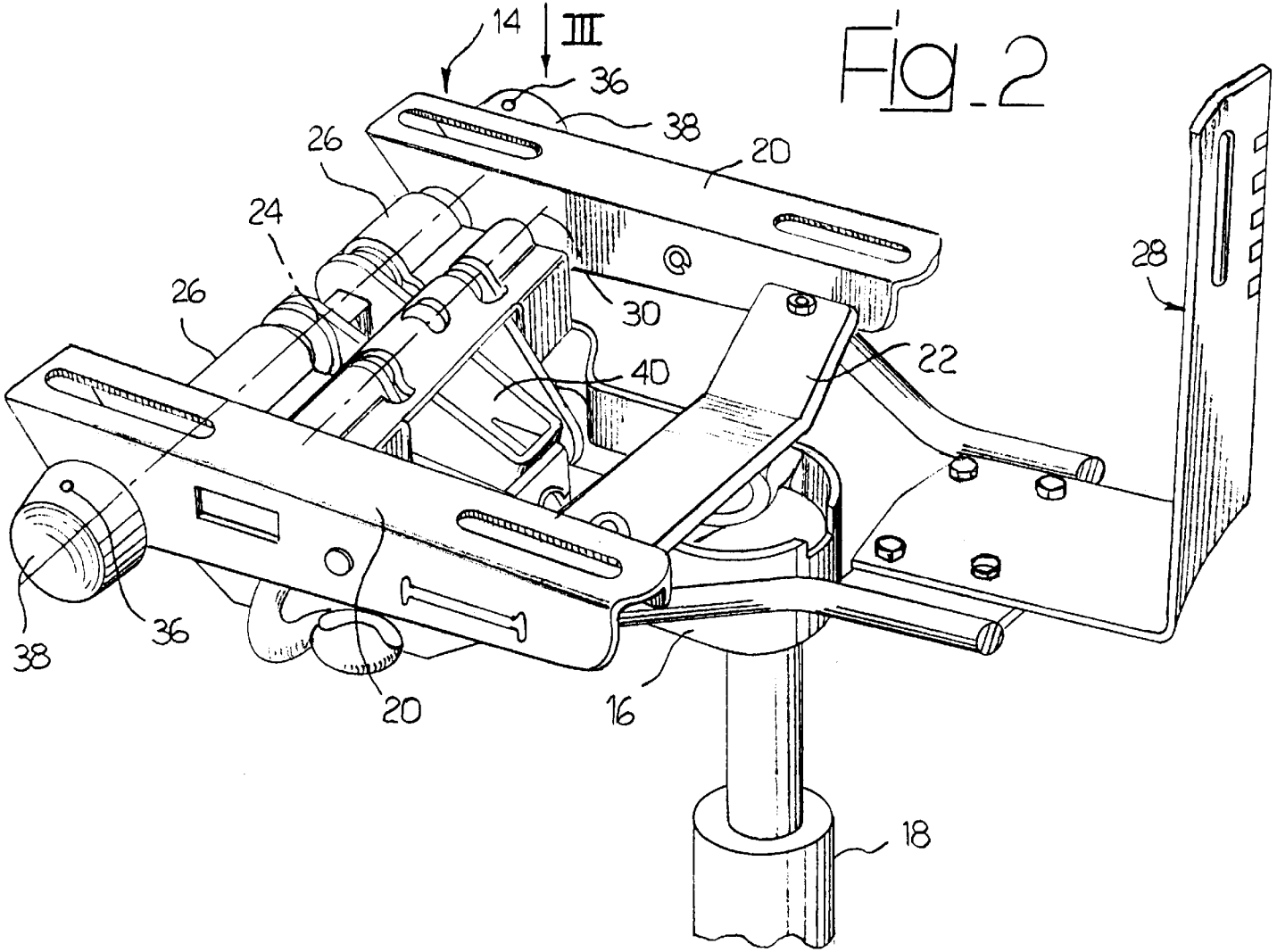
FIG. 2 is a perspective view of the mechanism for tilting the seat of the chair in FIG. 1.
Figure 3:
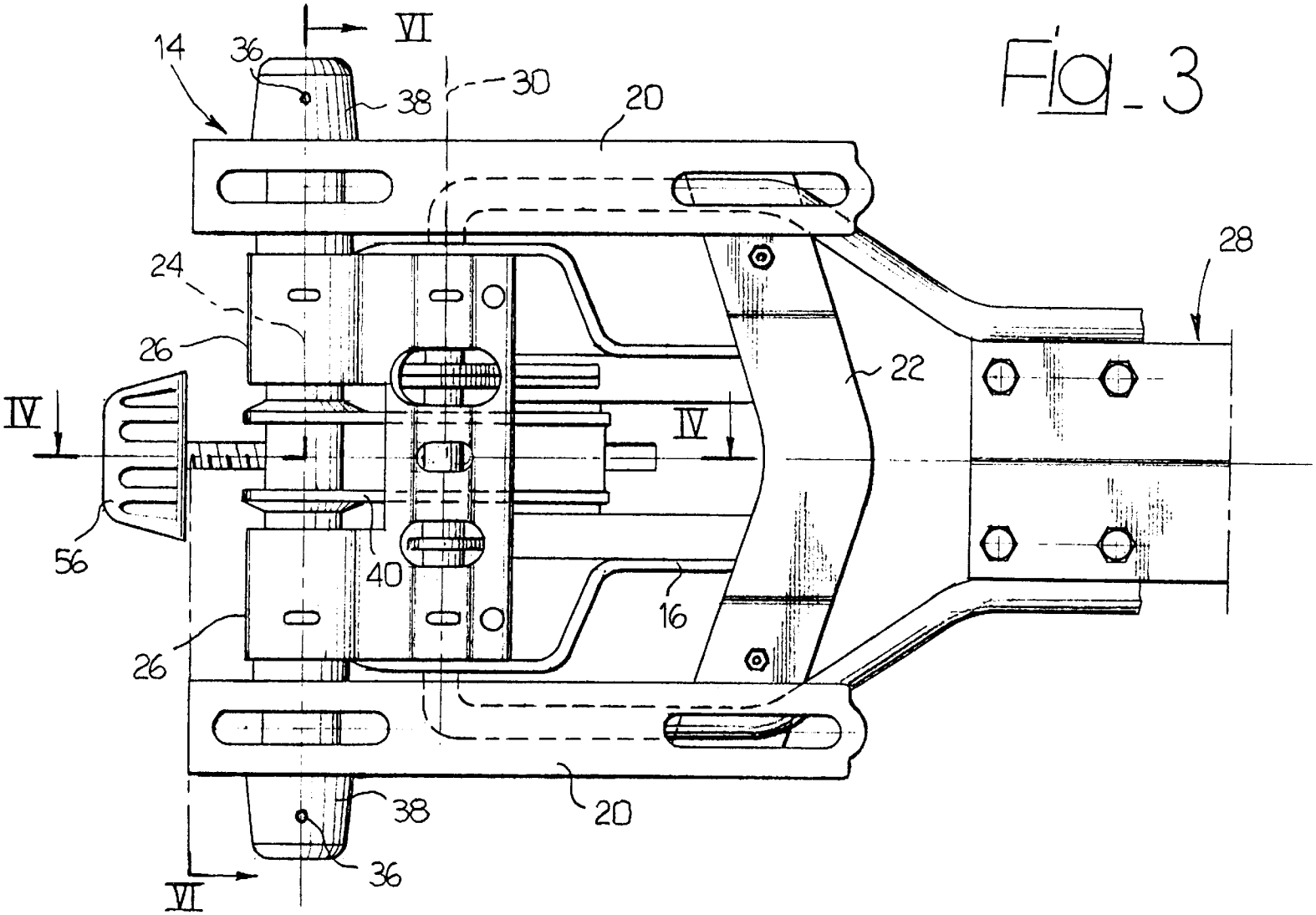
FIG. 3 is a plan view along the arrow III in FIG. 2, FIGS. 4 and 5 are cross sections along the line IV—IV in FIG. 3 in two different working positions.

With reference to FIG. 2, from the point of view of its construction, seat support structure 14 comprises two longitudinal members 20 of bent sheet, which are spaced apart in a transverse direction and connected together by a rear plate 22. Base structure 16 is formed of a body of substantially a box shape which has a transverse tilting axis 24 about which is tiltably mounted seat supporting structure 14. A pair of tubular members 26 are fixed to longitudinal members 20 and are arranged coaxially with tilting axis 24.

In FIG. 2, 28 indicates a supporting structure for the back. This supporting structure is tiltably mounted on base structure 16 about a second transverse tilting axis 30 parallel to tilting axis 24 and set at a slight distance from the latter towards the rear of the chair. Back support structure 28 is connected by means of a pair of tie bars (not illustrated) to seat supporting structure 14, so that the tilting movements of the seat and back are synchronized. A mechanism for immobilizing the seat and the back in a plurality of operating positions is described in detail in a simultaneous patent application by the same applicant.

Figures 4, 7:
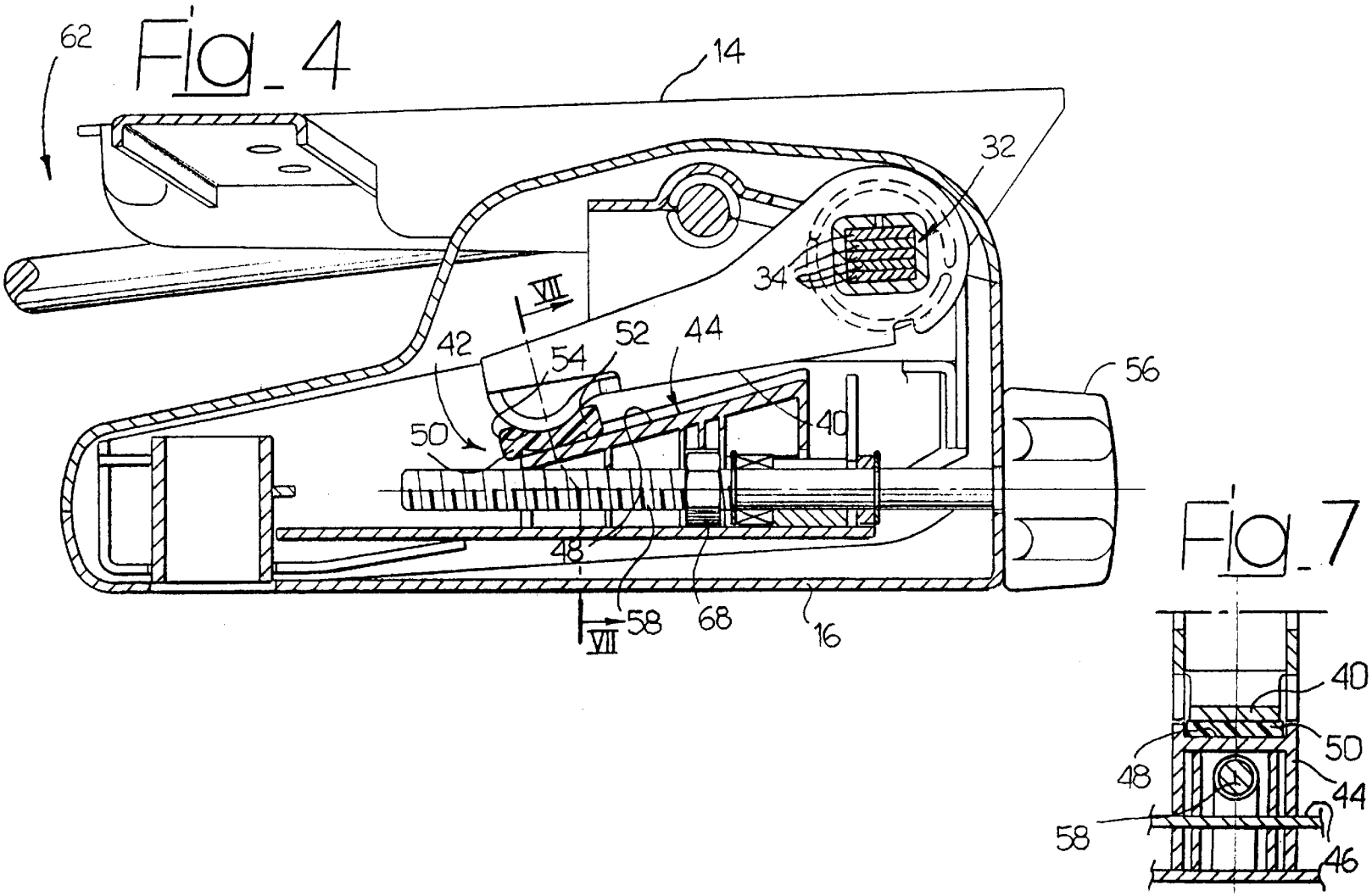
FIG. 7 is a cross section along the line VII—VII in FIG. 4.
Figure 5:
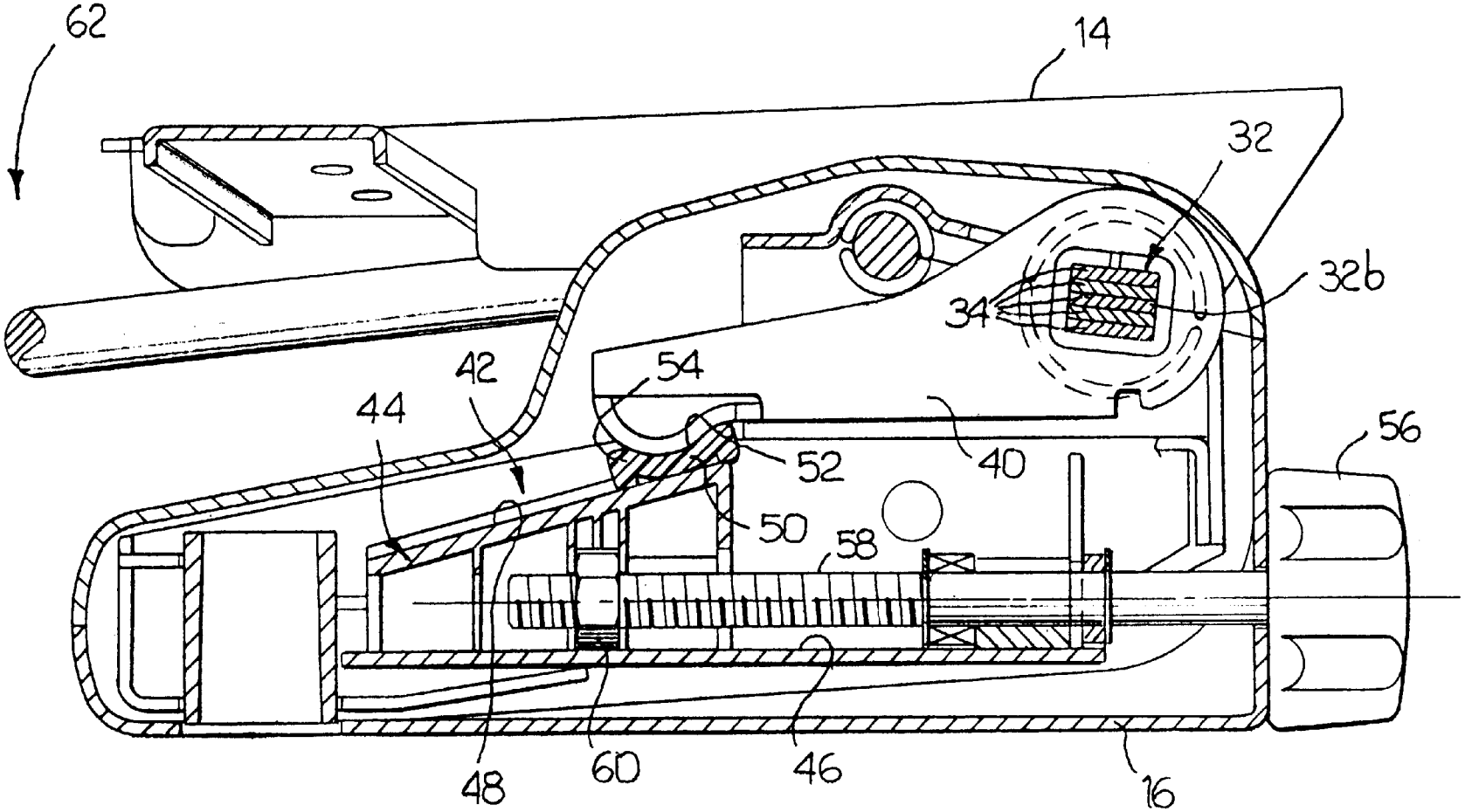

With reference to FIGS. 4, 5 and 6, tilting axis 24 of seat supporting structure 14 comprises a torsion bar 32 which extends coaxially with axis 24. From the point of view of its construction, torsion bar 32 comprises a plurality of extended rods 34 having a transverse cross section of flattened rectangular shape. The various rods 34 are placed on top of each other and fixed together in such a way as to form a bar of quadrangular transverse cross section with an extension in the transverse direction which is slightly greater than the distance between longitudinal side members 20 of seat supporting structure 14. As can be seen in particular in FIG. 6, end portions 32*a* of torsion bar 32 project laterally outside the two longitudinal side members 20. End portions 32*a* of torsion bar 32 are fixed to tubular members 26 forming part of seat support structure 14. This attachment may for example be achieved by means of a pair of washers 35 welded to tubular members 26 which have quadrangular holes engaged by end portions 32*a*. A pair of transverse pins 36 prevents torsion bar 32 from moving in an axial direction. The portions of torsion bar 32 which project at the side are covered by corresponding caps 38. A central portion 32*b* of torsion bar 32 is rotatably connected to a lever 40. In the example illustrated in FIGS. 4 and 5, the rotatable connection between lever 40 and central portion 32*b* is achieved by the fact that lever 40 has a hole with a quadrangular cross section within which the central portion 32*b* of torsion bar 32 is inserted. With reference to FIGS. 4 and 5, lever 40 acts together with an adjustment device 42, supported by base structure 16, which is capable of varying the angular position of lever 40 with respect to the axis of torsion bar 32. In the embodiment illustrated in FIGS. 4 and 5, adjustment mechanism 42 comprises a wedge 44 which can slide in a longitudinal direction on a guide wall 46 of base structure 16. Wedge 44 has an inclined guide surface 48 along which is slidably mounted a shoe 50 having a concave seat 52 which supports a rounded end 54 of lever 40 (see also FIG. 7). Wedge 44 can be moved in a longitudinal direction by causing a knob 56 located outside base structure 16 in a central position on the front of the chair to rotate. Knob 56 is rotatably connected to a threaded rod 58 which is axially attached to base structure 16 and is free to rotate around its own longitudinal axis. Threaded bar 58 engages a threaded nut 60 which is fixed with respect to wedge 54. The elastic action of torsion spring 32 tends to hold lever 40 pressed against shoe 50. Thus movement of wedge 44 which is controlled manually by the user through knob 56 can vary the angular position of lever 40 which consequently alters the angular position of central section 32*b* of the torsion spring about its own axis. FIGS. 4 and 5 illustrate the two end-of-travel positions of wedge 44 which define the field of adjustment for device 42. Each angular position of lever 40 corresponds to a particular amount of preloading on torsion spring 32. Given that seat support structure 14 is fixed to the end of torsion bar 32, preloading of the torsion bar opposes tilting of the seat in the direction indicated by arrow 62 in FIGS. 4 and 5. The user therefore has the possibility of continuously adjusting the elastic force opposing the tilting movement of the seat between a minimum value and a maximum value. From the description above it will be understood that torsion bar 32 performs both the function of the elastic member which opposes the tilting movement of the seat and back, and that of the pivot member between the seat supporting structure and base structure 16. This arrangement renders the tilting mechanism for the seat particularly compact in that the space which is normally necessary to house the shaft providing the joint between the seat support structure and the base structure also incorporates the elastic member. Adjustment mechanism 42 makes it possible to achieve an extensive gearing down of the operating force, as a result of which knob 56 can be operated easily without having to apply excessive force.

Figure 8:
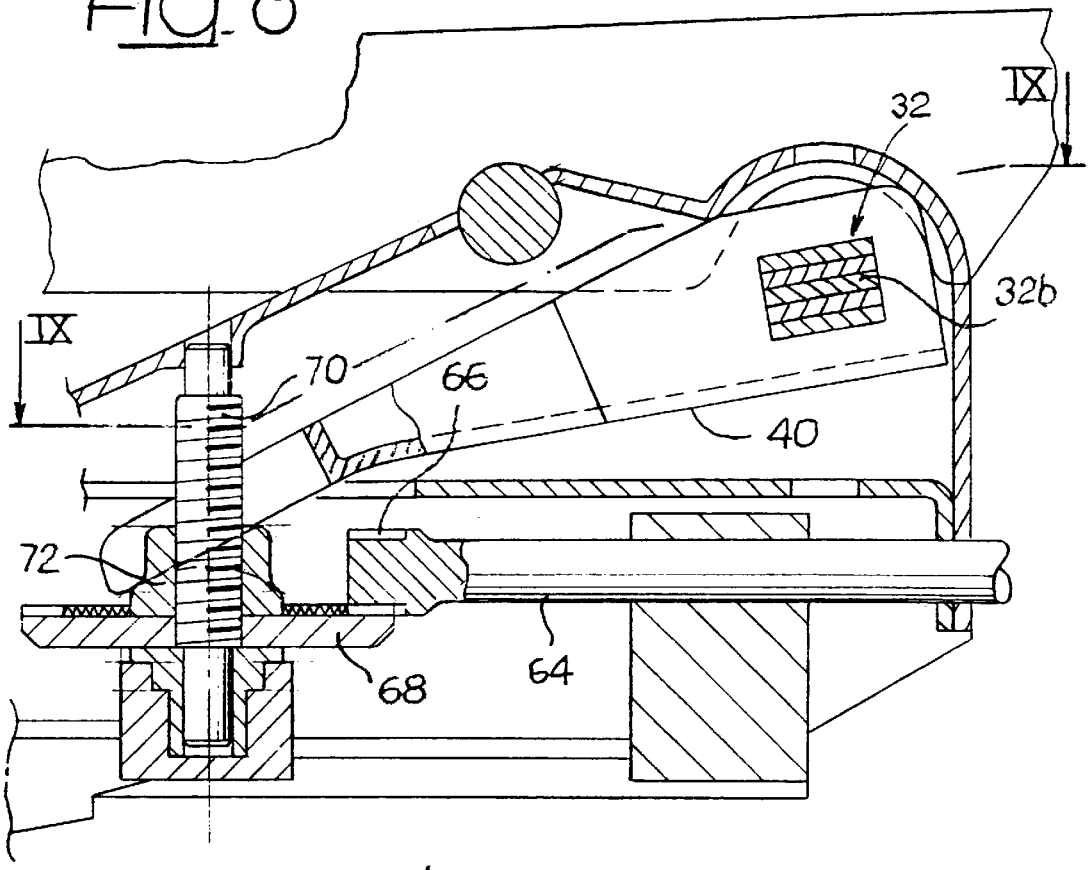
FIG. 8 is a cross section similar to that in FIGS. 4 and 5, illustrating a variant of this invention.
Figure 9:
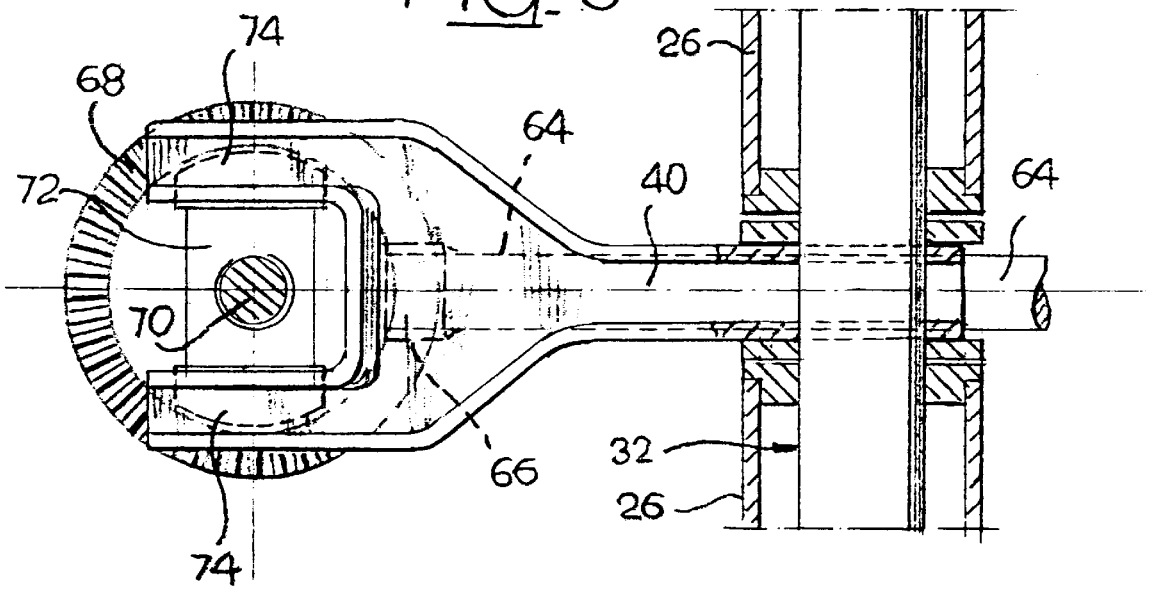
FIG. 9 is a diagrammatical cross section along the line IX—IX in FIG. 8.

FIGS. 8 and 9 illustrate a variant of the adjustment mechanism according to this invention. The details corresponding to those previously described are indicated by the same reference numbers. In this variant threaded rod 58 is replaced by a shaft 64 which has teeth 66 at one end which engage with a wheel 68 which can rotate with and is incorporated with a threaded rod 70. Threaded rod 70 is free to rotate about its own longitudinal axis and engages a nut 72. Lever 40 fixed in central section 32*b* of torsion bar 32 has a fork-shaped end with two limbs 74 which support nut 72 on opposite sides with respect to threaded bar 70. The elastic reaction force of torsion bar 32 exerts a downward force on nut 72 and prevents the latter from rotating about the axis of threaded rod 70. Therefore rotation of shaft 64 controlled by manually operated knob 56 (not visible in FIGS. 8 and 9) can be used to move nut 72 upwards and downwards and as a consequence to vary the angular position of lever 40. In this case too the user can vary the elastic force opposing the oscillating movement of the seat between a minimum value and a maximum value by rotating knob 56.

What is claimed is:

1. Chair with a tilting seat, comprising:

a base structure bearing a transverse tilting axis, a seat support structure, titlably mounted about said transverse tilting axis, elastic means capable of opposing the seat tilting motion, and adjustment means for varying the force opposing said elastic means, wherein the elastic means comprises a torsion bar which connects the seat support structure to the base structure in a tilting manner about said transverse tilting axis, the torsion bar having at least a first portion rotatably connected to the seat support structure and at least a second portion connected to the base structure through the adjustment means, wherein the adjustment means are arranged to vary the angular position of the second portion of the torsion spring about the transverse tilting axis, wherein the adjustment means comprise a lever fixed to the second portion of the torsion bar, a manually operable rotatable knob and a gearing-down device defining a correlation between the angular position of the knob and the angular position of the lever, and wherein the gearing-down device comprises a wedge which can slide in a longitudinal direction having an inclined surface which acts together with one end of the lever, the wedge being associated with a screw and nut mechanism capable of varying the axial position of the wedge in relation to the angular position of the operating knob.

2. Chair with a tilting seat, comprising:

a base structure bearing a transverse tilting axis, a seat support structure, titlably mounted about said transverse tilting axis, elastic means capable of opposing the seat tilting motion, and adjustment means for varying the force opposing said elastic means, wherein the elastic means comprises a torsion bar which connects the seat support structure to the base structure in a tilting manner about said transverse tilting axis, the torsion bar having at least a first portion rotatably connected to the seat support structure and at least a second portion connected to the base structure through the adjustment means, wherein the adjustment means are arranged to vary the angular position of the second portion of the torsion spring about the transverse tilting axis, wherein the adjustment means comprise a lever fixed to the second portion of the torsion bar, a manually operable rotatable knob and a gearing-down device defining a correlation between the angular position of the knob and the angular position of the lever, and wherein the gearing-down device comprises a pair of toothed wheels which mesh together, a first toothed wheel being rotatably connected to the knob and the second toothed wheel being incorporated with and rotating with a threaded rod which engages a nut which acts together with one end of the lever.

* * * * *